US006561189B2

(12) United States Patent
Schmidtke

(10) Patent No.: US 6,561,189 B2
(45) Date of Patent: May 13, 2003

(54) CONNECTING PART OF A BREATHING MASK

(75) Inventor: Klaus Schmidtke, Berlin (DE)

(73) Assignee: Auergesellschaft GmbH, Berlin (DE)

( * ) Notice: Subject to any disclaimer, the term of this patent is extended or adjusted under 35 U.S.C. 154(b) by 24 days.

(21) Appl. No.: 09/746,591

(22) Filed: Dec. 21, 2000

(65) Prior Publication Data

US 2002/0005199 A1 Jan. 17, 2002

(30) Foreign Application Priority Data

Dec. 23, 1999 (DE) ..... 199 63 598

(51) Int. Cl.[7] ..... A62B 18/08
(52) U.S. Cl. ..... 128/206.23; 2/206
(58) Field of Search ..... 128/202.27, 206.12, 128/206.21, 206.23, 206.24, 206.28, 201.12, 201.14, 201.15, 201.17, 201.19, 201.24, 201.27; 285/80, 81, 86, 305, 321; 2/206, 9, 205, 427, 429, 441, 443

(56) References Cited

U.S. PATENT DOCUMENTS

| | | | | | |
|---|---|---|---|---|---|
| 3,680,556 | A | * | 8/1972 | Morgan | 128/201.15 |
| 3,824,999 | A | * | 7/1974 | King | 128/185 |
| 4,841,953 | A | * | 6/1989 | Dodrill | 128/202.27 |
| 4,997,217 | A | * | 3/1991 | Kunze | 285/387 |
| 5,676,133 | A | * | 10/1997 | Hickle et al. | 128/205.12 |

FOREIGN PATENT DOCUMENTS

GB 2266247 * 10/1993

* cited by examiner

*Primary Examiner*—Aaron J. Lewis
*Assistant Examiner*—Mital Patel
(74) *Attorney, Agent, or Firm*—Wood, Phillips, Katz, Clark & Mortimer

(57) ABSTRACT

A connecting part for a breathing mask with an eye-protecting lens has a connecting piece inserted in an opening of the eye protecting lens and supported on a rim at the opening. The connecting piece has a connecting cylinder with holding elements and receptacles to hold the connecting piece on the rim by a detachably fixed U-shaped locking member.

28 Claims, 2 Drawing Sheets

CONNECTING PART OF A BREATHING MASK

DESCRIPTION

This invention relates to a connecting part of a breathing mask for connecting components such as filter, speech diaphragm, or exhalation valve that is inserted directly into the eye-protecting lens and guarantees easy assembly and disassembly.

The state of the art includes a multitude of solutions in which the connecting part for connecting components such as filter, speech diaphragm, etc. is placed in the mask body. These solutions are mostly accompanied by disadvantages; for example, that the area they take reduces the size of the eye-protecting lens, which limits the field of vision of the person wearing the mask.

DE-PS 23 04 866 only describes how hinge pins for internal lens wipers can be led through a lining in the eye-protecting lens, which cannot be compared with the solution according to this invention.

One solution is known from a breathing mask in the market where a connecting part is directly incorporated in the eye-protecting lens. In this solution, a clip for holding the connecting part is engaged with recesses in the rim of the eye-protecting lens. The disadvantages of this solution are higher manufacturing costs for the eye-protecting lens, complicated handling and the fact that the connecting piece is secured at only two force absorption points.

It is the object and problem of this invention to create a connecting part of a breathing mask for connecting components such as filter, speech diaphragm, or exhalation valve that is inserted directly into the eye-protecting lens and guarantees secure fixing as well as easy assembly and disassembly.

This problem is solved according to the invention by creating a connecting part of a breathing mask that is directly placed in the eye-protecting lens where a clamp shaped locking member is sitting on the rim of the eye-protecting lens in such a way that the clamping elements of the locking member move into engagement with the receptacles of a connecting piece, where the connecting piece comprises holding elements designed to interlock with said locking member, and where a fixing element is sitting on the rim of the eye-protecting lens.

The solution according to the invention enables easy assembly and disassembly of the connecting part and provides a high level of safety for the person wearing the mask for its intended purpose as force from the connected parts such as a filter is absorbed at a minimum of three points.

Because of the design of the locking member, the connecting part according to the invention of a breathing mask is an especially space-saving solution featuring easy-handling short assembly paths, and direct and short flow of force.

This solution intentionally abstains from expensive piercing of the eye-protecting lens or its rim.

The invention will be explained in more detail below, with reference to an embodiment as shown in the figures.

Figure 1:
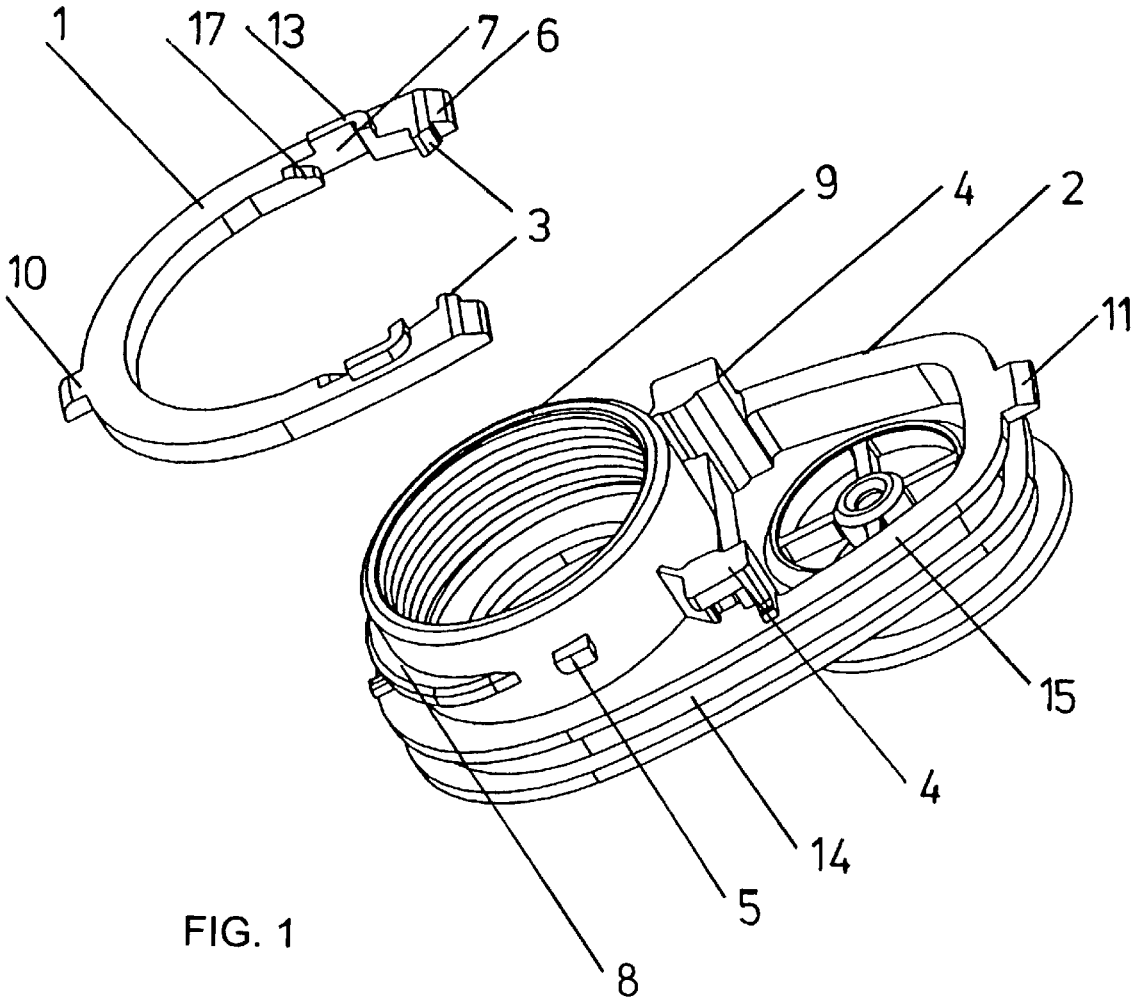

FIG. 1 Locking member 1 and connecting piece 2

Figure 2:
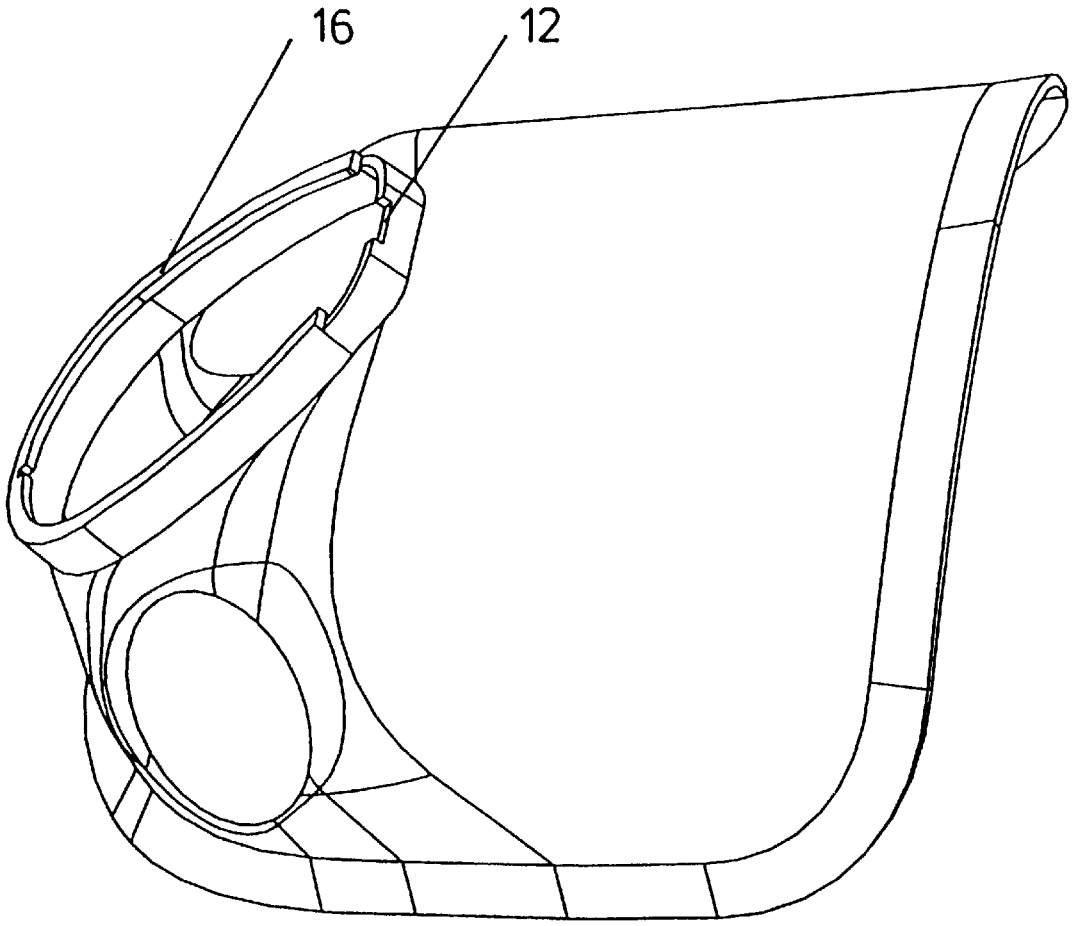

FIG. 2 Eye-protecting lens

When assembling the connecting part of the invention, the connecting piece 2 is pushed from inside through an opening of the eye-protecting lens so that the fixing element 11 is inserted in a groove 12 in the rim of the lens and the bearing surface 15 sits close to the rim 16 of the lens. Subsequently, the clamp-shaped/U-shaped locking member us placed from outside upon the eye-protecting lens so that spaced, elongate legs straddle/encompass the projecting connecting element/cylinder 9 while the recesses 7 and their antagonistic holding elements 5 act as a guidance until the locking member fits tightly with the rim 16 of the lens. The design according to the invention of locking member 1 where the distance between the clamping elements 3 is smaller than the diameter of the connecting cylinder 9 causes preliminary fixation during assembly: the locking element 1 cannot slip off; the only other way it can go would be in opposite direction for disassembly. When pressing lightly on the locking member 1 and pushing it towards the oppositely opening receptacles 4 of the connecting piece 2, the locking member 1 deforms, allowing the clamping elements 3 of locking member 1 to become engaged biasably with the receptacles 4 of the connecting piece 2. In this process, locking element 1 slides underneath the holding elements 5 and 8 that act as a mating holder and is captive between the rim 16 of the lens and the holding elements 5, 8. This process is facilitated by the rising chamfers 6 and 17 on the locking member and additional rising chamfers on the holding elements 5.

For easy disassembly after use, e.g. for cleaning the eye-protecting lens and the connecting part, the locking member 1 is equipped with projecting gripping elements 13. When these gripping elements are deformed by being slightly pressed outwards, the clamping elements 3 can be unclamped from the receptacles 4, and the locking member can be pushed in the opposite posite direction of the engagement until the recesses 7 and holding elements 5 are positioned upon each other. The piece can now easily be detached by moving it against the direction of assembly.

To seal the locking member against the eye-protecting lens, an O-ring is inserted into groove 14 of connecting piece 2 before the latter is inserted into the lens as described. This O-ring presses against the rim of the lens after assembly and ensures safe sealing against the ambient atmosphere.

The design of locking member 1 and connecting piece 2 in combination with the eye-protecting lens results in force absorption from the connecting part at six points: holding elements 5 and 8, receptacles 4, and fixing element 11.

The fixing elements 10 and 11 are also used for holding a protective cap.

The holding elements 5, the recesses 7 and the fixing element 11 are not required in another embodiment wherein force is absorbed at three points. This design reduces manufacturing costs while still providing a fully operational variant.

I claim:

1. A connecting part of a breathing mask having an eye protecting lens and an opening with a rim on the eye protecting lens and a connecting piece supported with a bearing surface on the rim, wherein the connecting piece has a first fixing element sitting on the rim and a connecting cylinder projecting away from the rim and holding elements and receptacles on the surface of the connecting cylinder, and wherein a U-shaped locking member partly encompassing the connecting cylinder and having clamping elements is placed between the rim and the holding elements, the clamping elements locked in the receptacles.

2. The connecting part according to claim 1 wherein the U-shaped locking member comprises chamfers and recesses to facilitate assembly of the U-shaped locking member.

3. The connecting part according to claim 1 wherein the U-shaped locking member comprises a second fixing element for holding a protective cap together with the first fixing element.

4. The connecting part according to claim 1 wherein the U-shaped locking member is equipped with gripping elements to facilitate disassembly.

5. The connecting part according to claim 1 wherein the connecting cylinder has a diameter and the spacing between the clamping elements is smaller than the diameter of the connecting cylinder.

6. The connecting part according to claim 1 wherein the holding elements are undercutting elements.

7. In combination:

an eye-protecting lens having a rim;

a connecting piece of a breathing mask placed directly on the eye-protecting lens, the connecting piece comprising at least a first receptacle and at least a first holding element; and a locking member that is separate from the eye-protecting lens and connecting piece, the locking member interlocking with the at least first holding element and engaging with the at least first receptacle and acting between the eye-protecting lens and connecting piece to maintain the connecting piece and eye protecting lens in assembled relationship.

8. The combination according to claim 7 wherein the locking member sits on the rim of the eye-protecting lens.

9. The combination according to claim 7 wherein the locking member resides captively between the at least first holding element and the rim on the eye-protecting lens.

10. The combination according to claim 9 wherein the connecting piece comprises a second holding element and the locking member resides captively between the first and second holding elements and the rim on the eye-protecting lens.

11. The combination according to claim 7 wherein the connecting piece further comprises a fixing element and the fixing element sits on the rim on the eye-protecting lens.

12. The combination according to claim 11 wherein the fixing element is inserted in a groove in the rim on the eye-protecting lens.

13. The combination according to claim 7 wherein the locking member is U-shaped.

14. The combination according to claim 13 wherein the locking member has spaced legs and there is a projecting gripping element on each of the legs to facilitate repositioning of the legs relative to each other.

15. The combination according to claim 7 wherein the connecting piece comprises a projecting connecting element and the locking member is U-shaped and straddles the projecting connecting element.

16. The combination according to claim 15 wherein the at least first holding element is on the projecting connecting element.

17. The combination according to claim 15 wherein the connecting element is cylindrical with an outer diameter, the locking member has spaced legs and clamping elements, one each on the spaced legs, and the clamping elements are spaced from each other a distance less than the outer diameter of the connecting element.

18. The combination according to claim 7 wherein the connecting piece comprises a second receptacle and the locking member interlocks with the first and second receptacles.

19. The combination according to claim 18 wherein the locking member comprises spaced clamping elements which fit one each into the first and second receptacles.

20. The combination according to claim 19 wherein the clamping elements are biased into the first and second receptacles.

21. The combination according to claim 19 wherein the locking member is deformable to allow the clamping elements to be moved towards and away from each other.

22. The combination according to claim 18 wherein the first and second receptacles open oppositely to each other.

23. The combination according to claim 7 wherein the connecting piece sits on the rim of the eye-protecting lens.

24. The combination according to claim 7 wherein a sealing element seals between the connecting piece and the eye-protecting lens.

25. The combination according to claim 24 wherein the connecting piece has a groove and the sealing element comprises a sealing ring in the groove.

26. The combination according to claim 7 wherein the locking member has at least one chamfer to act guidingly against the connecting piece to facilitate assembly of the locking member to the connecting piece.

27. The combination according to claim 7 wherein the locking member has at least one recess thereon to receive a part of the connecting piece and thereby facilitate assembly of the locking member to the connecting piece.

28. The combination according to claim 7 wherein the locking member is U-shaped with spaced legs each having a length and the locking member can be assembled to and disassembled from the connecting piece and eye-protecting lens by movement in a line parallel to the length of the elongate legs between the rim of the eye-protecting lens and the at least first holding element.

* * * * *